US010978817B2

(12) United States Patent
Miyamoto et al.

(10) Patent No.: US 10,978,817 B2
(45) Date of Patent: Apr. 13, 2021

(54) CONNECTOR FOR MOUNTING TO A SUBSTRATE

(71) Applicant: JAPAN AVIATION ELECTRONICS INDUSTRY, LIMITED, Tokyo (JP)

(72) Inventors: Junichi Miyamoto, Tokyo (JP); Hironori Kanda, Tokyo (JP); Toshihiro Oka, Tokyo (JP); Shigeyasu Kitamura, Tokyo (JP); Masao Yamamoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/486,669

(22) PCT Filed: Feb. 16, 2018

(86) PCT No.: PCT/JP2018/005437
§ 371 (c)(1),
(2) Date: Aug. 16, 2019

(87) PCT Pub. No.: WO2018/155330
PCT Pub. Date: Aug. 30, 2018

(65) Prior Publication Data

US 2020/0059023 A1 Feb. 20, 2020

(30) Foreign Application Priority Data

Feb. 23, 2017 (JP) ..... JP2017-031682

(51) Int. Cl.
*H01R 13/652* (2006.01)
*H01R 12/71* (2011.01)
*H01R 13/6581* (2011.01)

(52) U.S. Cl.
CPC ..... *H01R 12/71* (2013.01); *H01R 13/6581* (2013.01)

(58) Field of Classification Search
CPC ..... H01R 13/652; H01R 13/6594; H01R 13/6587; H01R 13/6581; H01R 12/724; H01R 12/71
(Continued)

(56) References Cited

U.S. PATENT DOCUMENTS 6,139,367 A * 10/2000 Yeh ..... H01R 13/6585 439/607.17
6,354,875 B1 * 3/2002 Wu ..... H01R 13/658 439/607.13
(Continued)

FOREIGN PATENT DOCUMENTS

EP 3086416 10/2016
JP 2008-41419 2/2008
(Continued)

OTHER PUBLICATIONS

Extended European Search Report, European Patent Office, Application No. 18757042.9, dated Feb. 5, 2020.
(Continued)

*Primary Examiner* — Hien D Vu
(74) *Attorney, Agent, or Firm* — Greenblum & Bernstein, P.L.C.

(57) ABSTRACT

A substrate-mounting connector includes a housing, a contact mounted to the housing, and a shield shell. The shield shell includes a first plate and a second plate disposed adjacently. A part of the first plate serves as a first contact portion. A first extension piece is formed in the second plate. A part of the first extension piece serves as a second contact portion. A part of the housing serves as a pressing portion facing the first plate, in a covering state in which the shield shell is mounted to the housing. A part of the first plate, different from the first contact portion, or a part of the first extension piece, different from the second contact portion, serves as a pressed portion pressed by the pressing portion
(Continued)

in the covering state. The pressing portion presses the pressed portion to make the first contact portion contact the second contact portion.

24 Claims, 9 Drawing Sheets

(58) Field of Classification Search
USPC ..... 439/108, 607.35, 0.4, 79
See application file for complete search history.

(56) References Cited

U.S. PATENT DOCUMENTS

| | | | | |
|---|---|---|---|---|
| 7,351,105 | B2 * | 4/2008 | Delaney | H01R 12/714 439/607.36 |
| 7,753,733 | B2 * | 7/2010 | Kameyama | H01R 12/724 439/607.35 |
| 7,806,735 | B1 | 10/2010 | Chen et al. | |
| 8,360,808 | B2 * | 1/2013 | Tsuchiya | H01R 12/724 439/607.55 |
| 9,385,480 | B2 * | 7/2016 | Miyoshi | H01R 13/658 |
| 9,559,469 | B2 * | 1/2017 | Nishimori | H01R 13/6594 |
| 2007/0015413 | A1 | 1/2007 | Morohoshi et al. | |
| 2015/0263457 | A1 | 9/2015 | Miyoshi | |
| 2016/0006198 | A1 | 1/2016 | Ueda et al. | |

FOREIGN PATENT DOCUMENTS

| | | |
|---|---|---|
| JP | 2013-4437 | 1/2013 |
| JP | 2014-41797 | 3/2014 |
| JP | 2015-176657 | 10/2015 |
| JP | 2016-18589 | 2/2016 |

OTHER PUBLICATIONS

International Search Report issued in International Patent Application No. PCT/JP2018/005437, dated Apr. 10, 2018 (with English translation).

* cited by examiner

CONNECTOR FOR MOUNTING TO A SUBSTRATE

TECHNICAL FIELD

The present invention relates to a connector for mounting to a substrate, hereinafter abbreviated as a substrate-mounting connector, the substrate-mounting connector having a shield shell.

BACKGROUND ART

FIGS. 1A and 1B show the structure of a receptacle connector described in Patent Literature 1 as a prior art example of this type of a substrate-mounting connector. A receptacle connector 10 includes an insulating housing 11, a shield-shell metal fitting 12, contacts 13, and a shield cover 14. The shield-shell metal fitting 12 and the contacts 13 are integrally mounted to the insulating housing 11. The shield cover 14 is mounted to the insulating housing 11 along a rear flat surface and both side surfaces of the insulating housing 11.

The shield-shell metal fitting 12 has a joining sheath 12*a*. The joining sheath 12*a* joins a mating plug to be inserted into the receptacle connector 10. The insulating housing 11, to which the shield-shell metal fitting 12 is mounted, covers an outer peripheral surface and a rear opening of the joining sheath 12*a*, the mating plug being to be inserted into a front opening of the joining sheath 12*a*. The insulating housing 11 has a support plate (hidden in FIGS. 1A and 1B) protruding forward in the joining sheath 12*a*. Contact parts (hidden in FIGS. 1A and 1B) located at the front tips of the contacts 13, which are mounted to the insulating housing 11, are located along the support plate of the insulating housing 11 and are exposed. The legs 13*a* of the contacts 13 protrude backward from the insulating housing 11. The legs 13*a* of the contacts 13 are enclosed by the shield cover 14.

Two contact pieces 14*a* formed in the shield cover 14 are press fitted into two insertion holes 11*a* formed in the insulating housing 11. Each of the contact pieces 14*a* is in contact with an exposed portion of the joining sheath 12*a*, the exposed portion being exposed via a corresponding insertion hole 11*a*. In FIGS. 1A and 1B, two grounding legs 12*b* are formed in the shield-shell metal fitting 12, and the shield-shell metal fitting 12 is exposed externally at outside exposure portions 12*c* via two insertion holes 11*b* formed in the insulating housing 11.

In the receptacle connector 10, the contacts 13 are electromagnetically shielded by two external shields, namely, the shield-shell metal fitting 12 and the shield cover 14. Therefore, high-frequency signals flowing through the contacts 13 are prevented from radiating externally, and external noise is also prevented from being superimposed on the high-frequency signals.

PRIOR ART LITERATURE

Patent Literature

Patent Literature 1: Japanese Patent Application Laid Open No. 2014-41797

SUMMARY OF THE INVENTION

Problems to be Solved by the Invention

A substrate-mounting connector provided with a shield shell covering a housing that holds a contact does not provide a sufficient shielding effect when an electrically conductive path through which noise (high-frequency noise) passes in the shield shell is long. Therefore, it is important to make an electrically conductive path through which noise passes as short as possible.

In general, a shield shell is made by pressing one metal sheet. In other words, one metal sheet is bent to form a shape that covers two or more surfaces of a housing. Therefore, two adjacent surfaces made by bending are not directly short-circuited. In the prior art receptacle connector 10, shown in FIGS. 1A and 1B, the shield cover 14, which covers the insulating housing 11, actually has a structure in which two adjacent surfaces are not directly short-circuited.

In the shield cover 14, shown in FIGS. 1A and 1B, noise received by a rear plate portion 14*b*, which covers the rear of the insulating housing 11, from the legs 13*a* of the contacts 13 passes through an upper mounting plate portion 14*c*, which covers a flat surface of the insulating housing 11, the contact pieces 14*a*, the exposed portions of the joining sheath 12*a*, and the grounding legs 12*h* in that order. Therefore, the electrically conductive paths through which noise passes are not short. From this viewpoint, the receptacle connector 10 does not have good shielding performance.

To improve the shieling performance, it is possible, for example, to form a grounding terminal at the rear plate portion 14*b* of the shield cover 14 and to form a ground pattern on the substrate where the receptacle connector 10 is mounted. Connecting the grounding terminal to the ground pattern makes the electrically conductive path through which noise passes shorter. In that case, however, the degree of freedom in design is hindered. For example, when land patterns for connecting a large number of contacts 13 are densely provided, it is difficult to form a ground pattern; therefore, to form a ground pattern, the number of contacts 13 is limited. If a ground pattern is formed away from the land patterns, the distance from the ground pattern to the grounding terminal becomes long.

To improve the shielding performance, it is also possible to form a grounding terminal at the mounting plate portion 14*c* of the shield cover 14, In that case, however, the length of the electrically conductive path through which noise passes mainly depends on the height of the rear plate portion 14*b*. When the design conditions cannot be changed freely due to reasons such as the dimensions of a mating plug and the manufacturing standard, it is not always possible to make the height of the rear plate portion 14*b* small.

The inventors found that an electrically conductive path through which noise passed was formed only in consecutive planes in the conventional cases. In other words, the inventors noticed that this fact constrained the degree of freedom in design and the reduction in the length of the electrically conductive path through which noise passed.

An object of the present invention is to provide a substrate-mounting connector having good shielding performance in which as short an electrically conductive path as possible through which noise can pass is realized in a shield shell and a position of a grounding terminal is not constrained in the shield shell.

Means to Solve the Problems

A connector for mounting to a substrate (a substrate-mounting connector), according to the present invention includes a housing formed of an insulator; a contact mounted to the housing; and a shield shell formed of a metal plate.

The shield shell is mounted to the housing and covers the contact. The shield shell includes a first plate and a second plate disposed adjacently. When the shield shell is not mounted to the housing, the first plate does not contact the second plate.

A part of the first plate serves as a first contact portion. A first extension piece is formed in the second plate. A part of the first extension piece serves as a second contact portion.

A part of the housing serves as a pressing portion facing the first plate, when the shield shell is mounted to the housing. A part of the first plate, different from the first contact portion, or a part of the first extension piece, different from the second contact portion, serves as a pressed portion pressed by the pressing portion when the shield shell is mounted to the housing.

When the shield shell is mounted to the housing, the pressing portion presses the pressed portion to make the first contact portion contact the second contact portion.

Effects of the Invention

According to the present invention, a short-circuited path is formed between two adjacent plates forming an edge having a gap in a shield shell. This short-circuited path serves as an electrically conductive path through which noise passes in the shield shell. In other words, whereas an electrically conductive path through which noise passed was formed only in consecutive plates in conventional examples, a new electrically conductive path is provided between non-consecutive plates according to the present invention. Therefore, a substrate-mounting connector according to the present invention includes, in a shield shell, an electrically conductive path through which noise can pass and which is as short as possible, thus providing good shielding performance. As in the structure of the present invention described above, the position of the grounding terminal in the shield shell is not limited.

BRIEF DESCRIPTION OF THE DRAWINGS

FIG. 4(*a*) is a front perspective view of the shield shell; FIG. 4(*b*) is a rear perspective view of the shield shell, shown in FIG. 4(*a*); FIG. 4(*c*) is an enlarged view of part "a" shown in FIG. 4(*b*); FIG. 4(*d*) is a partially cutaway view showing part "a";

FIG. 6(*a*) is a partially enlarged view of the shield shell, shown in FIG. 4; FIG. 6(*b*) is a sectional view showing a state in which the portion shown in FIG. 6(*a*) is mounted to a housing;

FIG. 10(*a*) is a perspective view of a shield shell; FIG. 10(*b*) is an enlarged view of part "a" shown in FIG. 10(*a*); FIG. 10(*c*) is a partially cutaway view showing part "a";

FIG. 11(*a*) is a perspective view of a shield shell; FIG. 11(*b*) is an enlarged view of part "a" shown in FIG. 11(*a*); and FIG. 11(*c*) is a partially cutaway view showing part "a".

DETAILED DESCRIPTION OF THE EMBODIMENTS

Figure 1A:
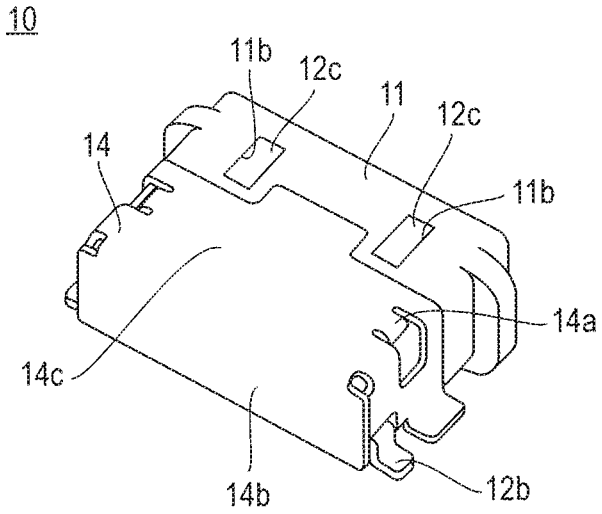
FIG. 1A PRIOR ART
FIG. 1A is a perspective view showing an example structure of a conventional substrate-mounting connector.
Figure 1B:
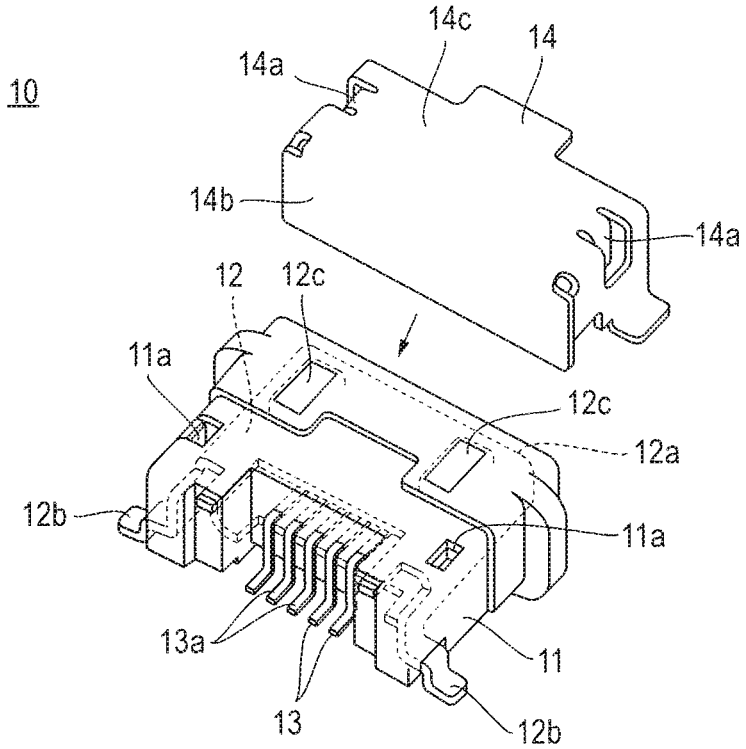
FIG. 1B PRIOR ART
FIG. 1B is an exploded perspective view of the structure shown in FIG. 1A.

Embodiments of the present invention will be described by referring to the drawings.

First Embodiment

Figure 2A:
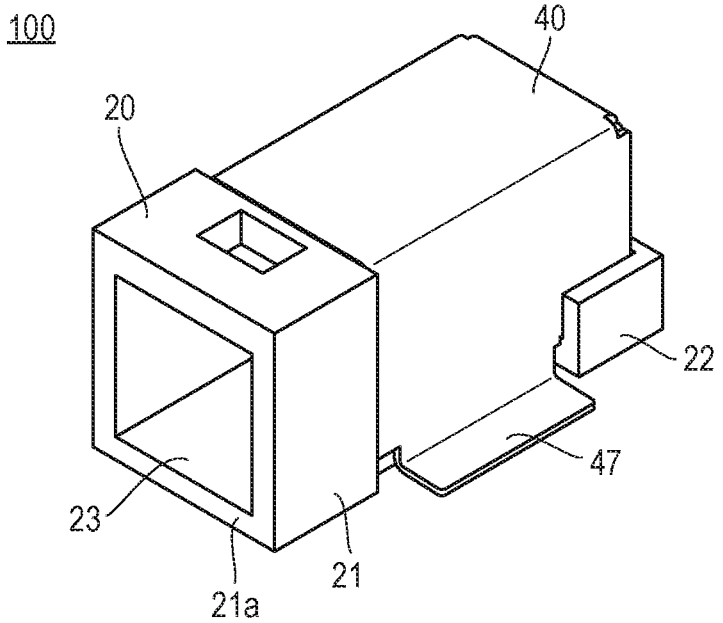
FIG. 2A is a front perspective view showing a substrate-mounting connector according to a first embodiment of the present invention.
Figure 2B:
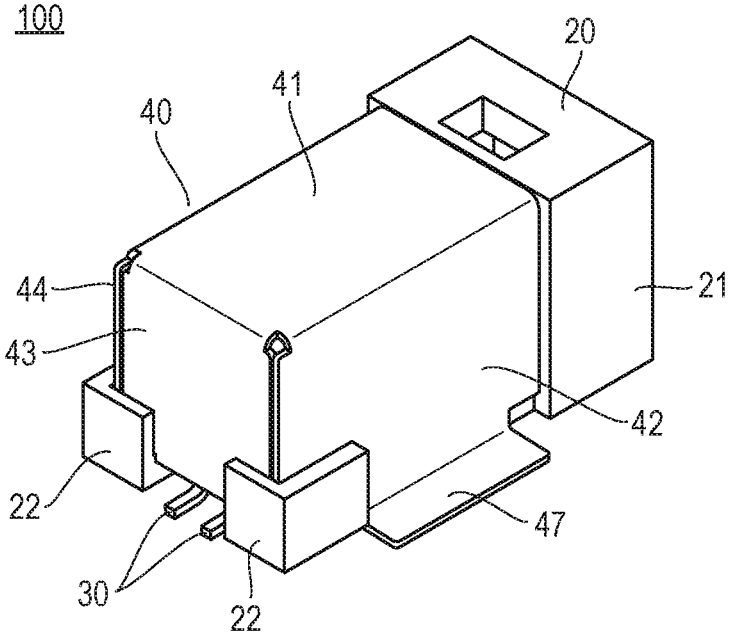
FIG. 2B is a rear perspective view of the substrate-mounting connector shown in FIG. 2A.
Figure 3:
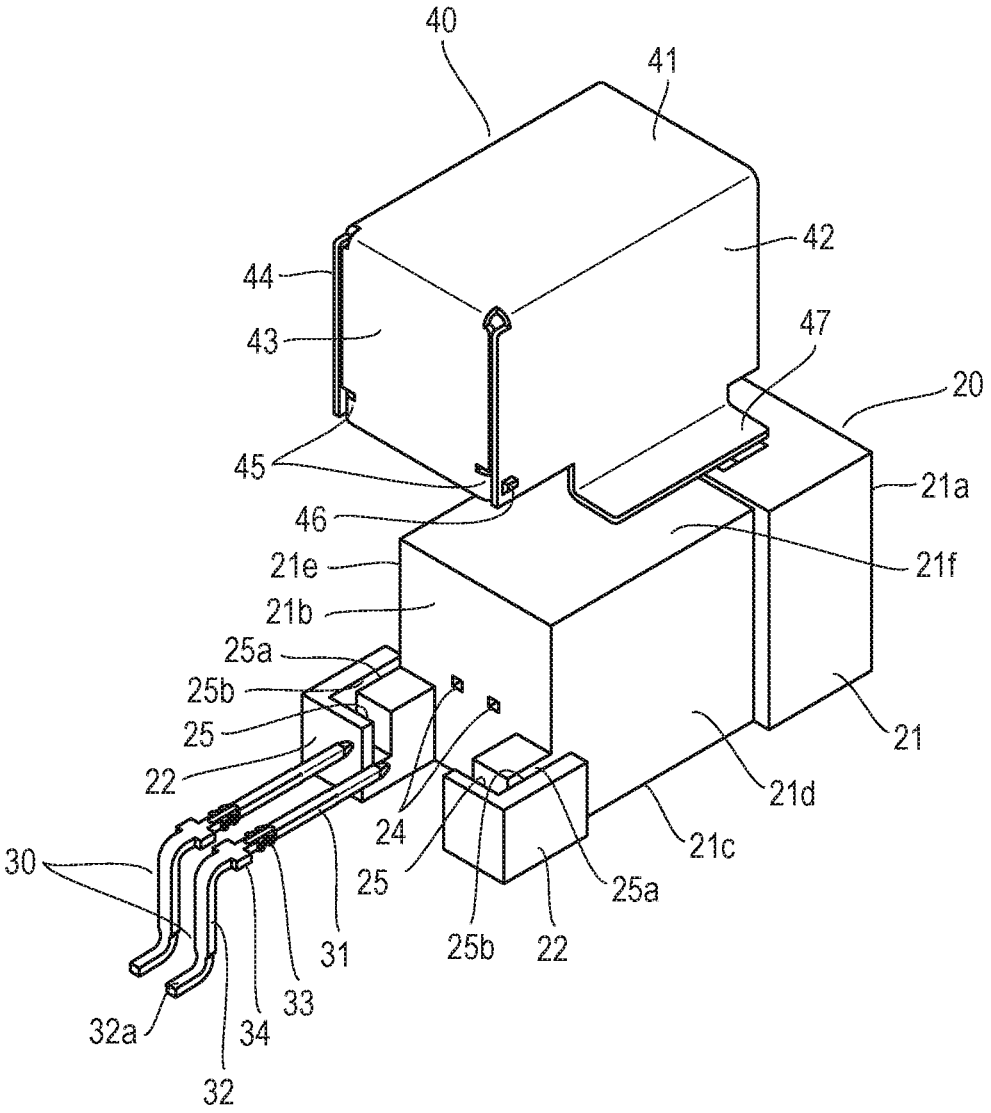
FIG. 3 is an exploded perspective view of the substrate-mounting connector shown in FIGS. 2A and 2B.

FIGS. 2A and 2B show a substrate-mounting connector 100, according to a first embodiment of the present invention. FIG. 3 shows components exploded from the substrate-mounting connector 100. In the first embodiment, the substrate-mounting connector 100 includes a housing 20, two contacts 30, and a shield shell 40. The housing 20 is formed of an insulator.

The housing 20 is made of a resin and has a rectangular-parallelepiped main body 21 and two receiving sections 22 protruding backward from the rear surface 21*b* of the main body 21. An opening 23 is formed at the front surface 21*a* of the main body 21. The opening 23 joins a mating connector to be inserted into the substrate-mounting connector 100. Two holes 24 into which the contacts 30 are press-fitted are formed at the rear surface 21*b* of the main body 21. The two holes 24 are communicated with the opening 23.

The two receiving sections 22 are located at two corners close to the bottom surface 21*c* on the rear surface 21*b*. L-shaped grooves 25 are formed at the upper surfaces of the receiving sections 22, the upper surfaces being close to the upper surface 21*f* of the main body 21. In one receiving section 22, the two ends of the groove 25 reach two adjacent sides of the upper surface of the receiving section 22. In the same way, in the other receiving section 22, the two ends of the groove 25 reach two adjacent sides of the upper surface of the receiving section 22. In one groove 25, a portion corresponding to one side of the L shape is parallel to the rear surface 21*b*, and a portion corresponding to the other side of the L shape is parallel to a side face 21*d* of the main body 21. In the same way, in the other groove 25, a portion corresponding to one side of the L shape is parallel to the rear surface 21*b*, and a portion corresponding to the other side of the L shape is parallel to a side face 21*e* of the main body 21. The grooves 25 have inside wall surfaces 25*a*.

The two contacts 30 are metal pins. Each contact 30 has a contact section 31 accommodated in the main body 21 of the housing 20 and a leg section 32 leading to the contact section 31. The front end of the leg section 32 is a terminal 32*a* to be connected to a land pattern on the substrate (not shown) with solder. A latch 33 for press fitting is formed at the base end of the contact section 31. A positioning protrusion 34 to contact the rear surface 21*b* of the main body 21 is formed at the base end of the leg section 32, which is led to the contact section 31.

Figure 4:
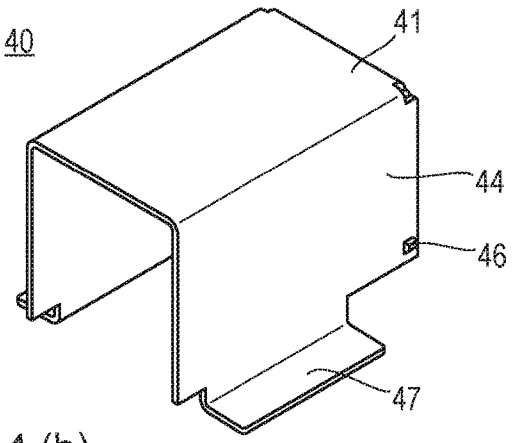
FIGS. 4(*a*) to 4(*d*) illustrate a shield shell shown in FIG. 3.
Figure 4:
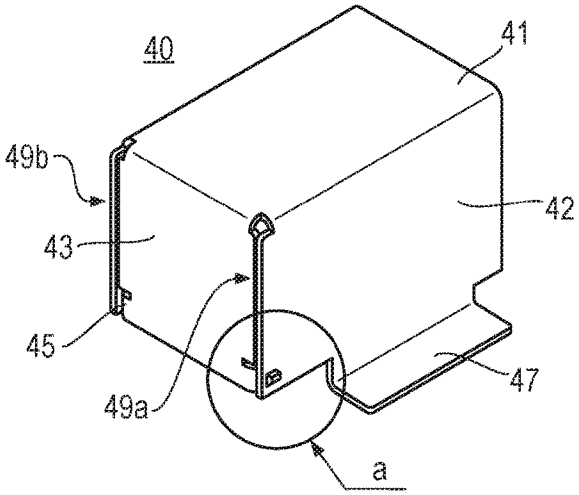
Figure 4:
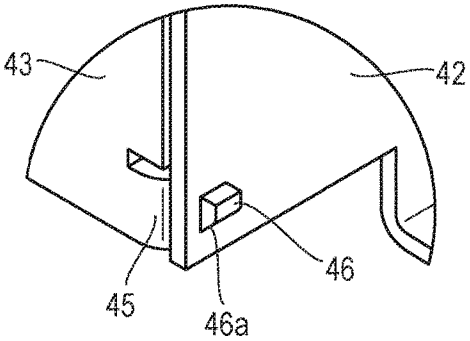
Figure 4:
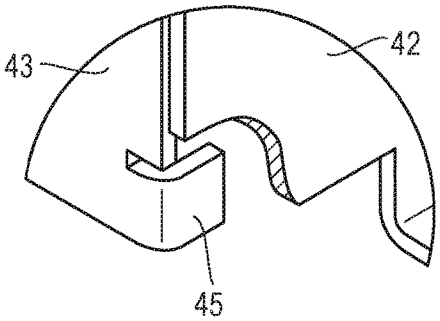

The shield shell 40 is made by bending a single metal sheet. FIGS. 4(*a*) to 4(*d*) show details of the shield shell 40. The shield shell 40, shown as an example, includes a rectangular plate 41 and three plates 42, 43, and 44. The three plates 42, 43, and 44 are bent from three sides of the rectangular plate 41 in the same direction. Adjacent plates 42 and 43 form an edge 49*a* with a gap therebetween. Adjacent plates 44 and 43 form an edge 49*b* with a gap therebetween. When the shield shell 40 is not mounted to the housing 20, the plate 42 does not contact the plate 43. In the same way, when the shield shell 40 is not mounted to the housing 20, the plate 44 does not contact the plate 43. In the first embodiment, the plate 42 or the plate 44 corresponds to a first plate, and the plate 43 corresponds to a second plate.

The shield shell 40 has the shape of a rectangular-parallelepiped box with openings at two adjacent surfaces. When the shield shell 40 is mounted to the housing 20, the shield shell 40 covers a rear side of the housing 20, that is, specifically the contacts 30. The rectangular plate 41 faces the upper surface 21*f* of the main body 21 of the housing 20, the plate 43 faces the rear surface 21*b* of the main body 21, and the plates 42 and 44 face the side surfaces 21*d* and 21*e* of the main body 21, respectively.

In the first embodiment, two extension pieces 45 are formed at a lower end of the plate 43, the lower end being away from the rectangular plate 41. The two extension pieces 45 are located at both ends in the width direction of the plate 43, the width direction being the direction in which the plates 42 and 44 face each other). As shown in FIG. 4(*d*), one extension piece 45 is bent at a right angle in a normal direction of the plate 43 and faces the inside surface of the plate 42. In the same way, the other extension piece 45 is bent at a right angle in the normal direction of the plate 43 and faces the inside surface of the plate 44. One protrusion 46 is formed at the outside plate surface of the plate 42. In the same way, another protrusion 46 is formed at the outside plate surface of the plate 44. When the plate 42 is viewed from the front thereof, the protrusion 46 formed at the plate 42 overlaps one extension piece 45. When the plate 44 is viewed from the front thereof, the protrusion 46 formed at the plate 44 overlaps the other extension piece 45. A plate-shaped grounding terminal 47 is formed at a lower end of the plate 42. In the same way, a plate-shaped grounding terminal 47 is formed at a lower end of the plate 44. It is preferred that the grounding terminal 47 be located close to the corresponding extension piece 45. Each grounding terminal 47 extends toward the outside of the shield shell 40. Each grounding terminal 47 is connected to a ground pattern of the substrate with solder.

Figure 5:
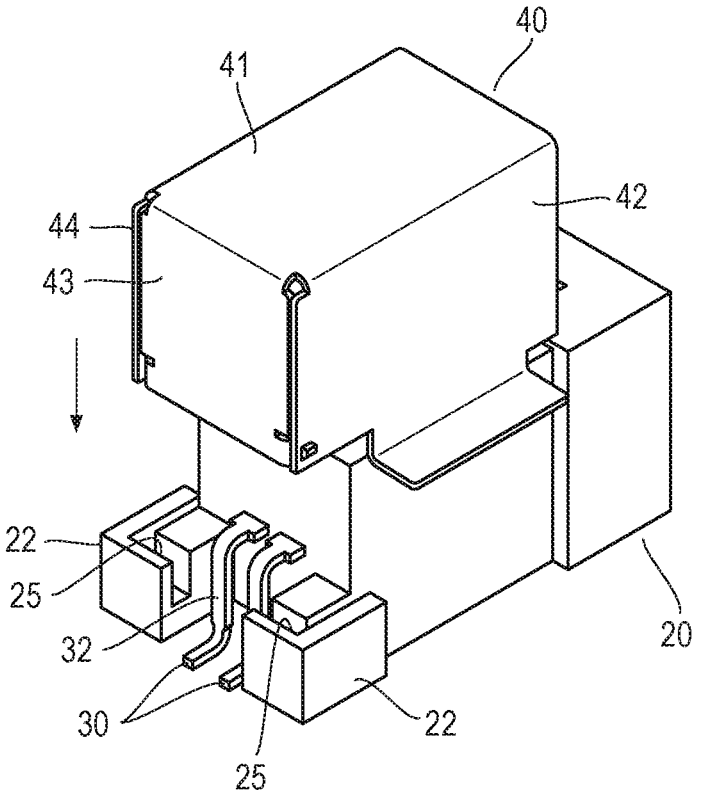
FIG. 5 is a view illustrating an assembly of the substrate-mounting connector shown in FIGS. 2A and 2B.

FIG. 5 shows a state in which the shield shell 40 is mounted to the housing 20 to which the contacts 30 have been mounted. The shield shell 40 is mounted to the housing 20 from above the housing 20. At that time, a lower part of the border formed by the plates 42 and 43 is inserted into the groove 25 of one receiving section 22, and a lower part of the border formed by the plates 43 and 44 is inserted into the groove 25 of the other receiving section 22. The leg sections 32 of the contacts 30, protruding from the housing 20, are located between the two receiving sections 22

Figure 6:
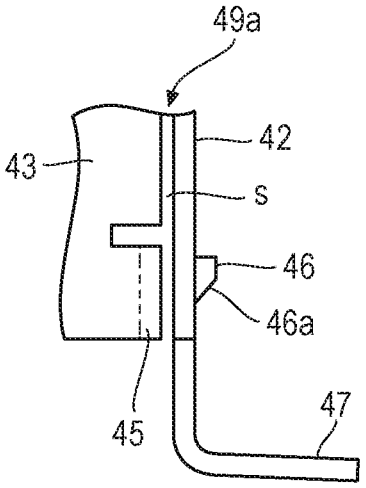
FIGS. 6(*a*) and 6(*b*) illustrate a short-circuited path.
Figure 6:
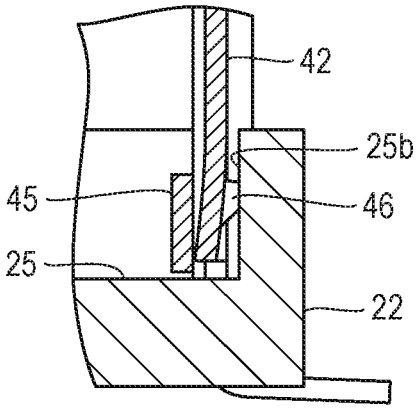

FIG. 6(*a*) is an enlarged view of a part where one extension piece 45 and one protrusion 46 are formed in the shield shell 40. When the shield shell 40 is not mounted to the housing 20, a gap "s" exists between the plates 42 and 43, which are located near each other so as to flank the edge 49*a*, as shown in FIG. 6(*a*). FIG. 6(*b*) shows a state in which the shield shell 40 is mounted to the housing 20 and the part shown in FIG. 6(*a*) is inserted into the groove 25 of one receiving section 22. When the two rear corners among the four corners located at a lower end of the shield shell 40 are inserted into the two grooves 25, one protrusion 46 is pressed by a pressing wall surface 25*b* of the groove 25, the pressing wall surface 25*b* being a wall surface outside the groove 25 that faces a part of the plate 42. Therefore, the plate 42 is bent (and displaced inward), as shown in FIG. 6(*b*), and contacts the extension piece 45.

The other extension piece 45 and the other protrusion 46 have the same relationship as that described above.

In the first embodiment, a part of the inside plate surface of the plate 42 or the plate 44 corresponds to a first contact portion; a part of the outside plate surface of the extension piece 45 corresponding to the first plate corresponds to a second contact portion; and each pressing wall surface 25*b*, which is a part of the housing 20, corresponds to a pressing portion. In addition, in the first embodiment, the protrusion 46 which is a part of the first plate and is different from the first contact portion corresponds to a pressed portion.

The lower surfaces of the two protrusions 46 are inclined surfaces 46*a*. Because of the inclined surfaces 46*a*, the shield shell 40 is easily inserted into the grooves 25.

As described for the contact between the plate 42 and the extension piece 45, in the first embodiment, when the shield shell 40 is mounted to the housing 20, one short-circuited path through one extension piece 45 is formed between the plate 43 and the plate 42, and in the same way, the other short-circuited path through the other extension piece 45 is formed between the plate 43 and the plate 44. Because the short-circuited paths, which serve as new electrically conductive paths, are formed in this manner, the electrically conductive paths through which noise passes are short. For example, noise received by the plate 43 from the leg sections 32 of the contacts 30 passes through the rectangular-parallelepiped plate 41 and the plates 42 and 44 to the grounding terminals 47 in the housing 20 when the short-circuited paths through the extension pieces 45 do not exist. However, when the short-circuited paths through the extension pieces 45 are formed, noise reaches the grounding terminals 47 without passing through the rectangular plate 41, and the electrically conductive paths from the leg sections 32 to the grounding terminals are very short. Therefore, according to the embodiment, noise passes through sufficiently short electrically conductive paths in the shield shell, providing a substrate-mounting connector having good shielding performance.

Second Embodiment

Figure 7:
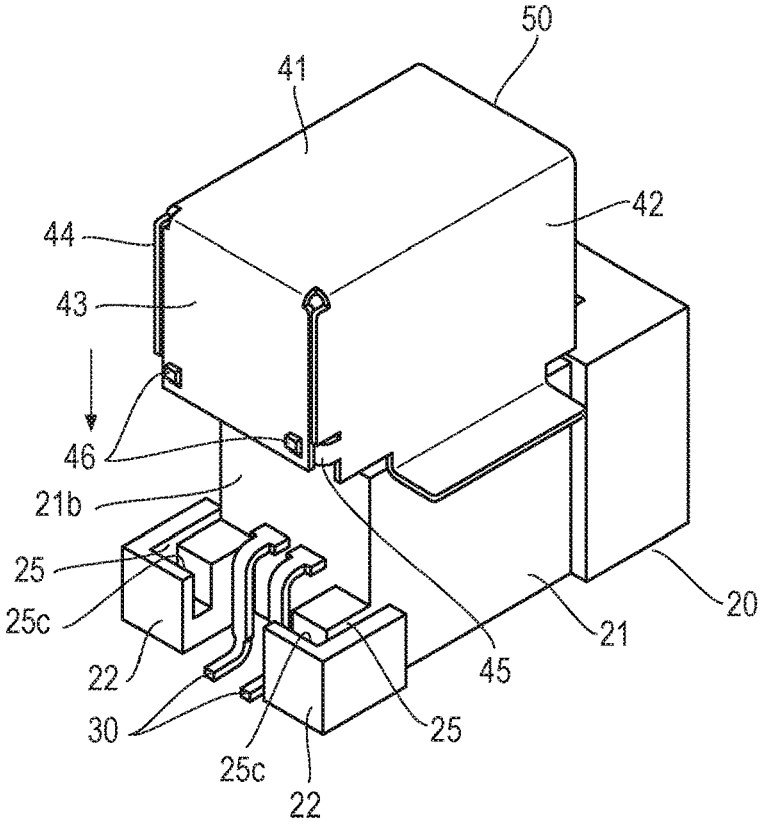
FIG. 7 is a view illustrating a substrate-mounting connector according to a second embodiment of the present invention.

In the shield shell 40 of the first embodiment, the two extension pieces 45 are formed in the plate 43; one protrusion 46 pressed by one pressing wall surface 25*b* is formed in the plate 42; and the other protrusion 46 pressed by the other pressing wall surface 25*b* is formed in the plate 44. However, the present invention is not limited to this structure. For example, a structure is allowed in which one extension piece 45 is formed in the plate 42; another extension piece 45 is formed in the plate 44; and two protrusions 46 are formed in the plate 43. FIG. 7 is a partially exploded perspective view of a substrate-mounting connector having a shield shell 50 having such a structure.

One extension piece 45 is formed at a lower end of the plate 42, the lower end being away from the rectangular plate 41. This extension piece 45 is located at an end of the plate 42, the end being close to the rear surface 21*b* in a length direction of the plate 42 and the length direction being parallel to the direction in which the front surface 21*a* and the rear surface 21*b* face each other when the shield shell 50 is mounted to the housing 20. In the same way, the other extension piece 45 is formed at a lower end of the plate 44. The other extension piece 45 is located at an end of the plate 44, the end being close to the rear surface 21*b* in the length direction of the plate 44. The two extension pieces 45, formed in the plates 42 and 44, are bent at right angles, respectively, and face the inside plate surface of the plate 43. Two protrusions 46 are formed in the plate 43. When the plate 43 is viewed from the front thereof, the two protrusions 46 overlap with the two extension pieces 45. In the second embodiment, the outside wall surface of one side (parallel to the rear surface 21*b*) of each L-shaped groove 25 serves as a pressing wall surface 25*c*, which presses the protrusion 46. The shield shell 50 is mounted to the housing 20 from above the housing 20.

In the second embodiment, the plate 42 or the plate 44 corresponds to the second plate, and the plate 43 corresponds to the first plate. In the second embodiment, a part of the inside plate surface of the plate 43 corresponds to the first contact portion; a part of the outside plate surface of each extension piece 45 corresponds to the second contact portion; and each pressing wall surface 25*c*, which is a part of the housing 20, corresponds to the pressing portion. In addition, in the second embodiment, each protrusion 46, which is a part of the first plate and is different from the first contact portion, corresponds to the pressed portion.

Third Embodiment

Figure 8:
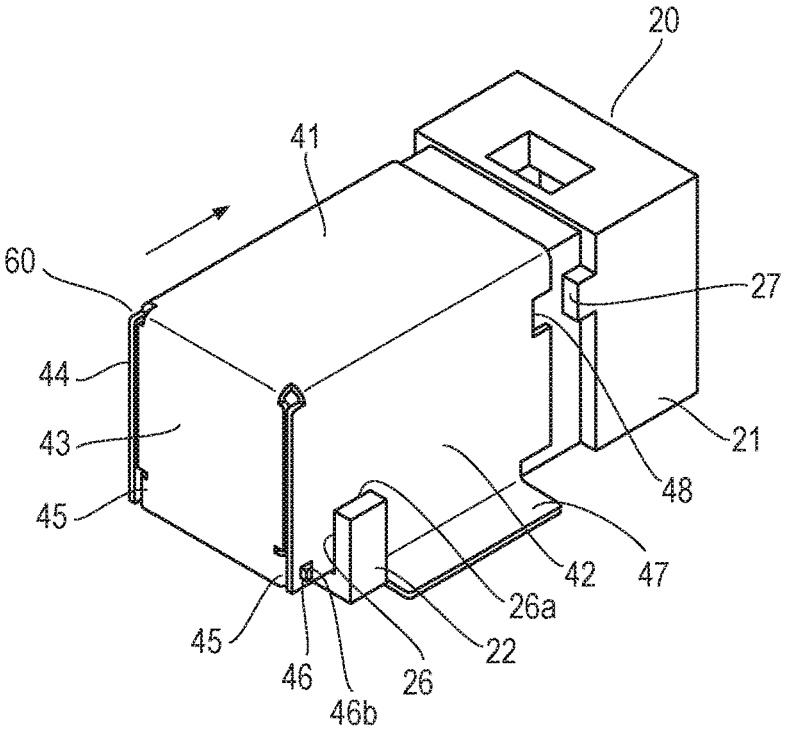
FIG. 8 is a view illustrating a substrate-mounting connector according to a third embodiment of the present invention.

FIG. 8 is a partially exploded perspective view of a substrate-mounting connector, the connector having a structure in which a shield shell is mounted to a housing from the back of the housing.

In a shield shell 60, two extension pieces 45 are formed in the plate 43, one protrusion 46 is formed in the plate 42, and another protrusion 46 is formed in the plate 44, in the same way as in the shield shell 40. The third embodiment differs from the first embodiment in that a groove 26 extending in the length direction of a housing 20 is formed in one receiving section 22 of the housing 20, and in the same way, another groove 26 extending in the length direction of the housing 20 is formed in the other receiving section 22. The shield shell 60 is assembled with the housing 20 from above the housing 20. At that time, the two receiving sections 22 are located between the protrusions 46 and the shielding terminals 47, a part of the plate 42 joins the groove 26 of one receiving section 22, and a part of the plate 44 joins the groove 26 of the other receiving section 22. In addition, when the shield shell 60 is slid toward the front surface 21*a* of the housing 20, a pressing wall surface 26*a*, which is the outside wall surface of the groove 26, presses the protrusion 46. In the third embodiment, the side surface of the protrusion 46, facing the front surface 21*a* when the shield shell 60 is mounted to the housing 20, is an inclined surface 46*b*. Two cutouts 48 are made at front ends of the plates 42 and 44 in the length direction and join two protrusions 27 formed at the main body 21 of the housing 20.

In the third embodiment, the plate 42 or the plate 44 corresponds to the first plate, and the plate 43 corresponds to the second plate. In the third embodiment, a part of the inside plate surface of the first plate corresponds to the first contact portion; a part of the outside plate surface of the extension piece 45 corresponding to the first plate corresponds to the second contact portion; and each pressing wall surface 26*a*, which is a part of the housing 20, corresponds to the pressing portion. In addition, in the third embodiment, the protrusion 46 which is a part of the first plate and is different from the first contact portion corresponds to the pressed portion.

Fourth Embodiment

The structure of a substrate-mounting connector, shown in FIG. 9, will be described next.

Figure 9:
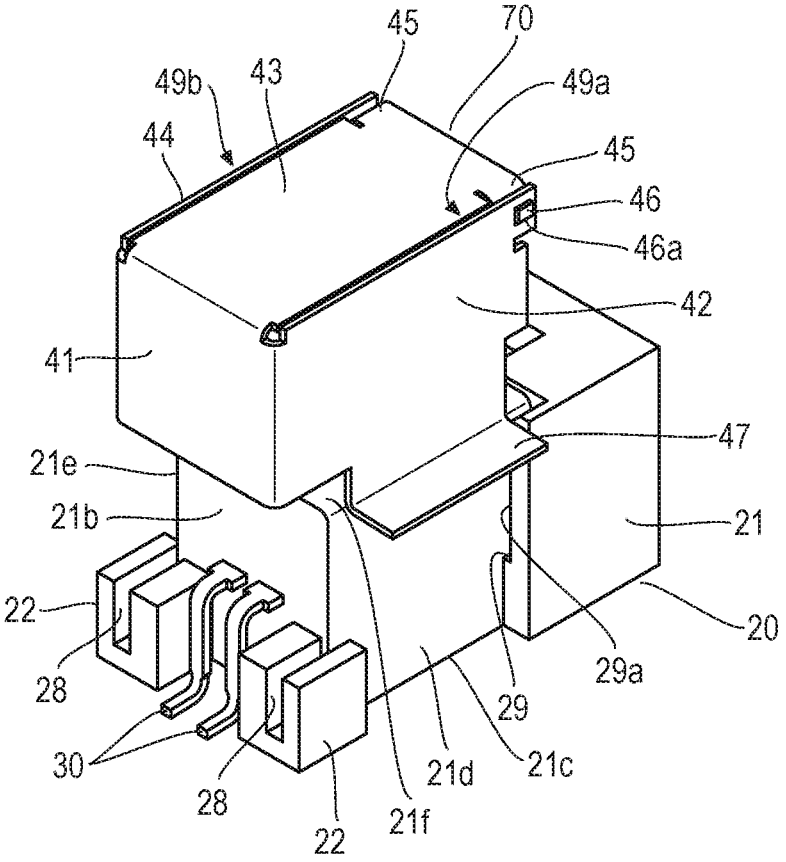
FIG. 9 is a view illustrating a substrate-mounting connector according to a fourth embodiment of the present invention.

A shield shell 70 for the substrate-mounting connector, shown in FIG. 9, includes a rectangular plate 41 and three plates 42, 43, and 44, in the same manner as the shield shell 40. The three plates 42, 43, and 44 are bent from three sides of the rectangular plate 41 in the same direction. Adjacent plates 42 and 43 form an edge 49*a* with a gap therebetween. Adjacent plates 44 and 43 form an edge 49*b* with a gap therebetween. In the fourth embodiment, when the shield shell 70 is mounted to the housing 20, the rectangular plate 41 faces the rear surface 21*b* of the main body 21.

In the shield shell 70, two extension pieces 45 are formed in the plate 43, one protrusion 46 is formed in the plate 42, and another protrusion 46 is formed in the plate 44, in the same way as in the shield shell 40. A groove 28 extending in the length direction of the housing 20 is formed in one receiving section 22 of the housing 20, and in the same way, another groove 28 extending in the length direction of the housing 20 is formed in the other receiving section 22. Two grooves 29 are formed in the main body 21 of the housing 20 in a height direction from the upper surface 21*f* to a predetermined depth, the height direction being a direction in which the upper surface 21 f and the bottom surface 21*c* face each other. The positions of the two grooves 29 correspond to those of front ends (tip ends) of the plates 42 and 44.

The shield shell 70 is assembled with the housing 20 from above the housing 20. The front end of the plate 42 is inserted into one groove 29, and the front end of the plate 44 is inserted into the other groove 29. A lower part of the rear end of the plate 42 is inserted into the groove 28 of one receiving section 22, and a lower part of the rear end of the plate 44 is inserted into the groove 28 of the other receiving section 22. In the fourth embodiment, a pressing wall surface 29*a*, which is the outside wall surface of each groove 29, presses the protrusion 46. The lower surface of each protrusion 46 is an inclined surface 46*a*. A grounding terminal 47 is formed at a lower end of the plate 42, and in the same way, another grounding terminal 47 is formed at a lower end of the plate 44.

In the fourth embodiment, one short-circuited path is formed between the plate 43, which faces the upper surface 21*f* of the main body 21 of the housing 20, and the plate 42, which faces a side surface 21*d*, and in addition, another short-circuited path is formed between the plate 43, which faces the upper surface 21*f* of the main body 21 of the housing 20, and the plate 44, which faces a side surface 21*e*. In this structure, noise received by the plate 43, located close to the upper surface 21*f*, from the outside reaches the grounding terminals 47 through short electrically conductive paths, without passing through the rectangular plate 41.

In the fourth embodiment, the plate 42 or the plate 44 corresponds to the first plate, and the plate 43 corresponds to the second plate. In the fourth embodiment, a part of the inside plate surface of the first plate corresponds to the first contact portion; a part of the outside plate surface of the extension piece 45 corresponding to the first plate corresponds to the second contact portion; and each pressing wall surface 29*a*, which is a part of the housing 20, corresponds to the pressing portion. In addition, in the fourth embodiment, the protrusion 46 which is a part of the first plate and is different from the first contact portion corresponds to the pressed portion.

Modifications

In each of the above described embodiments, in the shield shell, an extension piece is formed in one of the adjacent plates sandwiching an edge, and a pressed portion pressed by the pressing portion is formed in the other plate. Therefore, the extension piece, which is one contact portion, and the inside plate surface (specifically, the inside plate surface of the plate on which the protrusion is formed), which is the other contact portion, form a short-circuited path. However, the structure of the short-circuited path is not limited to this structure. Other structures will be described below by referring to FIG. 10 and FIG. 11.

First Modification

Figure 10:
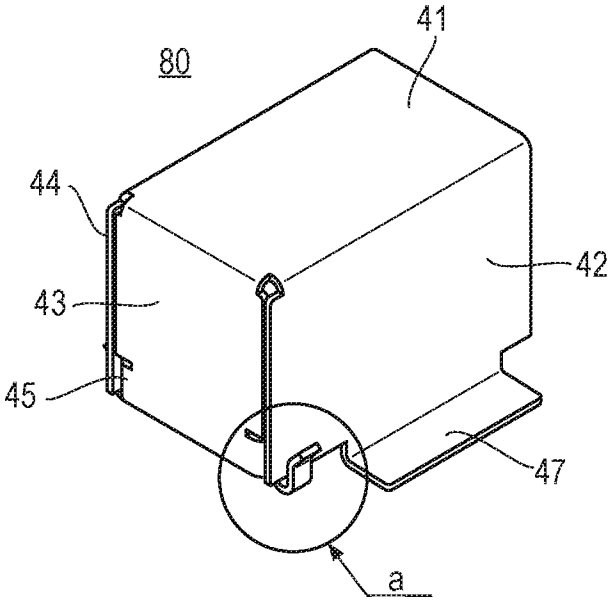
FIGS. 10(*a*) to 10(*c*) illustrate a first modification of the shield shell.
Figure 10:
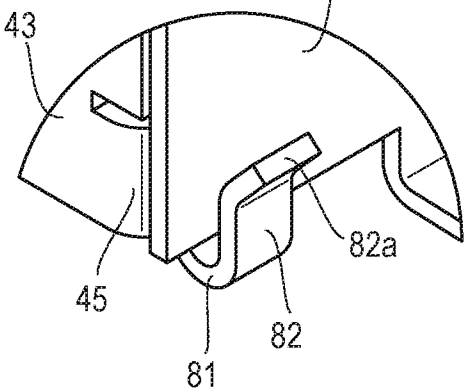
Figure 10:
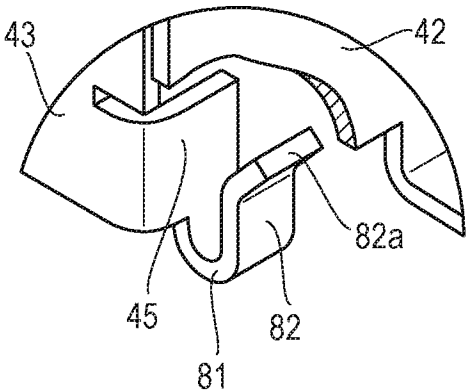

In a shield shell 80 shown in FIG. 10, one extension piece 45 formed in a plate 43 includes one extension section 81 that extends from an edge of the extension piece 45 in a direction perpendicular to the extension direction of the extension piece 45, and in the same way, the other extension piece 45 includes another extension section 81 that extends from an edge of the other extension piece 45 in a direction perpendicular to the extension direction of the other extension piece 45. Each extension section 81 is bent in a U shape. The bottom of the one extension section 81 goes around below the plate 42, which is positioned very close to the one extension section 81, and the bottom of the other extension section 81 goes around below the plate 44, which is positioned very close to the other extension section 81. The end of the one extension section 81 is located on the outer side of the plate 42, and the end of the other extension section 81 is located on the outer side of the plate 44.

In each extension section 81, the end of the extension section 81 is an insertion section 82, and a bent portion 82*a* slightly bent outward is formed at the tip of the insertion section 82.

One insertion section 82 is located in a gap between the plate 42 and a pressing portion formed in the housing 20 when the shield shell 80 is mounted to the housing 20. In the same way, the other insertion section 82 is located in a gap between the plate 44 and another pressing portion formed in the housing 20 when the shield shell 80 is mounted to the housing 20. When the pressing portion presses one bent portion 82*a*, the insertion section 82 is displaced, resulting in contact between the insertion section 82 and the plate 42. In the same way, when the other pressing portion presses the other bent portion 82*a*, the other insertion section 82 is displaced, resulting in contact between the other insertion section 82 and the plate 44. With this, one short-circuited path is formed between the plate 43 and the plate 42, and the other short-circuited path is formed between the plate 43 and the plate 44.

In the first modification, the plate 42 or the plate 44 corresponds to the first plate, and the plate 43 corresponds to the second plate. In the first modification, a part of the outside plate surface of the first plate corresponds to the first contact portion; a part (inside side surface) of the insertion section 82 corresponding to the first plate corresponds to the second contact portion; and each pressing wall surface, which is a part of the housing 20, corresponds to the pressing portion. In addition, in the first modification, a part (specifically, the bent portion 82*a*) of a first extension piece, different from the second contact portion, corresponds to the pressed portion. In other words, the second contact portion and the pressed portion are located in the insertion section.

Second Modification

Figure 11:
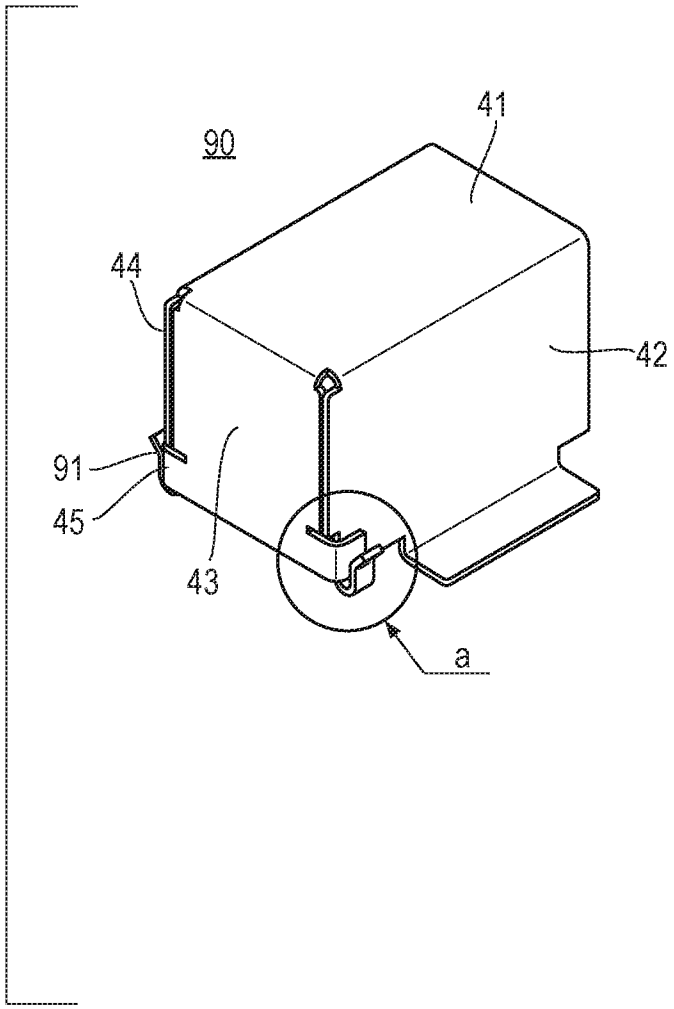
FIGS. 11(*a*) to 11(*c*) illustrate a second modification of the shield shell.
Figure 11:
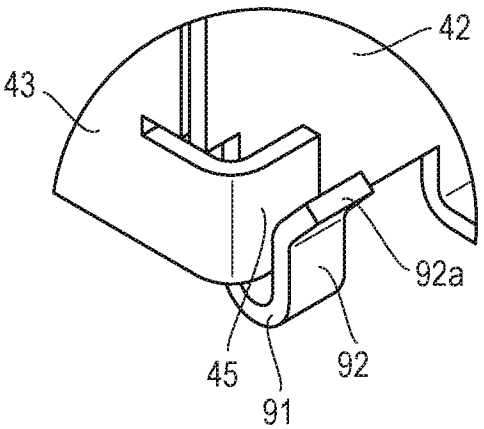
Figure 11:
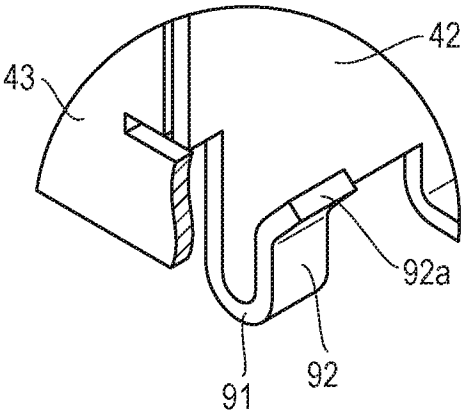

In a shield shell 90 shown in FIG. 11, one extension section 91 is formed in a plate 42, and in the same way, another extension section 91 is formed in a plate 44. Each extension section 91 is bent in a U shape. Two extension pieces 45 formed in a plate 43 are bent at right angles. One extension piece 45 faces the outside plate surface of the plate 42, and the other extension piece 45 faces the outside plate surface of the plate 44. The bottom of the one extension section 91 goes around below the one extension piece 45, and the bottom of the other extension section 91 goes around below the other extension piece 45. The end of the one extension section 91 is located on the outer side of the one extension piece 45, and the end of the other extension section 91 is located on the outer side of the other extension piece 45.

In each extension section 91, the end of the extension section 91 is an insertion section 92, and a bent portion 92*a* slightly bent outward is formed at the tip of the insertion section 92.

One insertion section 92 is located in a gap between the one extension piece 45 and a pressing portion formed in the housing 20 when the shield shell 90 is mounted to the housing 20. In the same way, the other insertion section 92 is located in a gap between the other extension piece 45 and a pressing portion formed in the housing 20 when the shield shell 90 is mounted to the housing 20. When the pressing portion presses one bent portion 92*a*, the one insertion section 92 is displaced, resulting in contact between the one insertion section 92 and the one extension piece 45. In the same way, when the other pressing portion presses the other bent portion 92*a*, the other insertion section 92 is displaced, resulting in contact between the other insertion section 92 and the other extension piece 45. With this, one short-circuited path is formed between the plate 43 and the plate 42, and the other short-circuited path is formed between the plate 43 and the plate 44.

In the second modification, the plate 42 or the plate 44 corresponds to the first plate, and the plate 43 corresponds to the second plate. In the second modification, a part (specifically, the inside side surface) of the insertion section 92 corresponding to the first plate corresponds to the first contact portion; a part of the outside side surface of the extension piece 45 corresponding to the first plate corresponds to the second contact portion; and each pressing wall surface, which is a part of the housing 20, corresponds to the pressing portion. In addition, in the second modification, a part (specifically, the bent portion 92*a*) of a second extension piece, different from the first contact portion, corresponds to the pressed portion. In other words, the first contact portion and the pressed portion are located in the second extension piece.

Additional Notes

In each of the embodiments and modifications described above, each pressing portion (each pressing wall surface), used to press the pressed portion to short-circuit adjacent plates of the shield shell, is located outside the shield shell when the shield shell is mounted to the housing and presses the pressed portion inward. The present invention is not limited to this type of structure; for example, employing a structure in which the pressing portion presses the pressed portion outward is also allowed. However, to prevent the contact portions from being exposed and the shield shell from expanding in the width direction, it is preferred that the pressed portion be pressed inward. The pressing portion is not limited to a groove wall surface. The groove in each receiving section is not always required.

In each of the cases described above, the shield shell has the rectangular plate 41 and three plates bent at right angles in an identical direction from three sides of the rectangular plate 41, and adjacent plates of the three plates form edges. However, the present invention is not limited to such a structure. For example, a shield shell having no rectangular plate, or a shield shell having a plate leading to a bend having a large radius of curvature is allowed.

To shorten the electrically conductive paths, it is preferred that the first contact portion and the second contact portion be away from the rectangular plate (for example, at peripheral portions of the corresponding plates or close to the peripheral portions).

To prevent high-frequency signals passing through the contacts from radiating outside, it is preferred that one of the first plate and the second plate face the contacts and the other be provided with a grounding terminal.

In each of the cases described above, in terms of ease of explanation, it was assumed that the shield shell receives noise from the leg sections of the contacts. However, noise received by the shield shell is not limited to noise received from the leg sections of the contacts. For example, the shield shell receives noise from the outside thereof. An advantage of the present invention will be additionally described for a case in which the noise source is not limited.

A connector actually manufactured satisfies L1>L2 or L2>L1, where L1 indicates the length between the first plate and the grounding terminal of the shield shell, and L2 indicates the length between the second plate and the grounding terminal of the shield shell. A case in which L1>L2 holds will be described.

When the shield shell receives noise, noise received by the first plate is not completely zero, in general. According to the present invention, since the electrically conductive path through which non-zero noise received by the first plate can pass and which bridges the first plate and the second plate (the electrically conductive path is shorter than L1) is provided, a substrate-mounting connector of the present invention has good shielding performance.

The same also applies when L2>L1.

In the present invention, an embodiment in which the plate of the shield shell, which faces the upper surface 21*f* of the housing 20, is also grounded, in addition to the grounding terminals, is also allowed. The structure of grounding is not limited. As an example, frame grounding is exemplified, in which a grounding terminal formed in the plate of the shield shell, which faces the upper surface 21*f* of the housing 20, is connected to the casing. The grounding terminals 47 may be connected to the casing, not to the ground pattern on the substrate.

According to the present invention, a short-circuited path is formed between plates adjacent to each other through a gap in a shield shell mounted to the housing. This short-circuited path serves as an electrically conductive path through which noise passes in the shield shell. In other words, whereas an electrically conductive path through which noise passed was formed only in consecutive plates in conventional examples, because a new electrically conductive path is provided between non-consecutive plates according to the present invention, a substrate-mounting connector having good shielding performance is realized.

In addition, according to the present invention, a substrate-mounting connector provides both compactness and good shielding performance in some cases. Some conventional connectors involve a trade-off in which good shielding performance (short electrically conductive path) is not obtained when a grounding terminal is located at a position where a compact connector is achieved; a compact connector is not achieved when a grounding terminal is located at a position where good shielding performance (short electrically conductive path) is obtained. However, according to the present invention, since an electrically conductive path that bridges the first plate and the second plate is provided, good shielding performance (short electrically conductive path) can be obtained when a grounding terminal is located at a position where a compact connector is achieved.

Although embodiments of the present invention have been described above, the present invention is not limited to the above described embodiments. Various changes and modifications are allowed without departing from the scope of the present invention. The selected and described embodiments are for explaining the principle of the present invention and its actual applications. The present invention is used in various embodiments with various changes or modifications, and the various changes or modifications are determined depending on expected uses. It is intended that all of such changes and modifications are included in the scope of the present invention, defined by the accompanying claims, and that the same protection is given when all of such changes and modifications are interpreted according to a width given equitably and legitimately with justice.

What is claimed is:

1. A connector configured to be mounted to a substrate, comprising:

a housing formed of an insulator;

a contact mounted to the housing; and a shield shell formed of a metal plate and mountable to the housing to cover the contact, wherein the shield shell has a first plate and a second plate, the first plate and the second plate being located adjacent to, but not directly contacting, each other in a state in which the shield shell is not mounted to the housing, the first plate has a first contact part at an end of the first plate, the second plate has a first extension piece at an end of the second plate, the first extension piece has a second contact part, the housing has a pressing part facing the first plate only after the shield shell is mounted to the housing, the first plate has a pressed part that protrudes outward from the first plate and that is different from the first contact part or the first extension piece has a pressed part that protrudes outward from the first extension piece and that is different from the second contact part, and the pressing part of the housing pushes against the pressed part to press together the first contact part of the first plate into contact with the second contact part of the first extension piece of the second plate only after the shield shell is mounted to the housing with the first and second plates fitted into a receiving section of the housing that receives the ends of the first and second plates.

2. The connector according to claim 1, wherein either the first plate or the second plate faces the contact, and the other of the first plate and the second plate has a grounding terminal.

3. The connector according to claim 1, wherein the pressing part is located outside the shield shell when the shield shell is mounted to the housing, and only after the shield shell is mounted to the housing, the pressing part presses the pressed part inward toward an inside of the shield shell.

4. The connector according to claim 3, wherein either the first plate or the second plate faces the contact, and the other of the first plate and the second plate has a grounding terminal.

5. The connector according to claim 1, wherein the shield shell comprises a rectangular plate and three plates, the three plates are bent in an identical direction from three sides of the rectangular plate, two adjacent plates of the three plates form an edge, and the first plate and the second plate are the two adjacent plates of the three plates.

6. The connector according to claim 5, wherein the rectangular plate faces a surface of the housing, the surface being opposite a substrate mounting surface of the housing.

7. The connector according to claim 5, wherein the rectangular plate faces a surface of the housing, the surface being opposite a surface of the housing on a side for connecting with a mating connector.

8. The connector according to claim 5, wherein the first contact part is located away from the rectangular plate, in the first plate, and the second contact part is located away from the rectangular plate, in the second plate.

9. The connector according to claim 3, wherein the shield shell comprises a rectangular plate and three plates, the three plates are bent in an identical direction from three sides of the rectangular plate, two adjacent plates of the three plates form an edge, and the first plate and the second plate are the two adjacent plates of the three plates.

10. The connector according to claim 9, wherein the rectangular plate faces a surface of the housing, the surface being opposite a substrate mounting surface of the housing.

11. The connector according to claim 9, wherein the rectangular plate faces a surface of the housing, the surface being opposite a surface of the housing on a side for connecting with a mating connector.

12. The connector according to claim 9, wherein the first contact part is located away from the rectangular plate, in the first plate, and the second contact part is located away from the rectangular plate, in the second plate.

13. The connector according to claim 1, wherein the pressed part is a protrusion formed on a plate surface of the first plate, the plate surface facing the pressing part.

14. The connector according to claim 13, wherein either the first plate or the second plate faces the contact, and the other of the first plate and the second plate has a grounding terminal.

15. The connector according to claim 3, wherein the pressed part is a protrusion formed on a plate surface of the first plate, the plate surface facing the pressing part.

16. The connector according to claim 15, wherein either the first plate or the second plate faces the contact, and the other of the first plate and the second plate has a grounding terminal.

17. The connector according to claim 1, wherein the first extension piece has an insertion section, the insertion section being located at a gap between the first plate and the pressing part only after the shield shell is mounted to the housing, and the second contact part and the pressed part are on the insertion section.

18. The connector according to claim 17, wherein either the first plate or the second plate faces the contact, and the other of the first plate and the second plate has a grounding terminal.

19. The connector according to claim 3, wherein the first extension piece has an insertion section, the insertion section being located at a gap between the first plate and the pressing part only after the shield shell is mounted to the housing, and the second contact part and the pressed part are on the insertion section.

20. The connector according to claim 19, wherein either the first plate or the second plate faces the contact, and the other of the first plate and the second plate has a grounding terminal.

21. The connector according to claim 1, wherein the first plate has a second extension piece, the second extension piece being located at a gap between the first extension piece and the pressing part only after the shield shell is mounted to the housing, and the first contact part and the pressed part are on the second extension piece.

22. The connector according to claim 21, wherein either the first plate or the second plate faces the contact, and the other of the first plate and the second plate has a grounding terminal.

23. The connector according to claim 3, wherein the first plate has a second extension piece, the second extension piece being located at a gap between the first extension piece and the pressing part only after the shield shell is mounted to the housing, and the first contact part and the pressed part are on the second extension piece.

24. The connector according to claim 23, wherein either the first plate or the second plate faces the contact, and the other of the first plate and the second plate has a grounding terminal.

* * * * *